US007246396B2

(12) United States Patent
Czyzewski et al.

(10) Patent No.: US 7,246,396 B2
(45) Date of Patent: Jul. 24, 2007

(54) PROCESS FOR OPERATING A WATER-BEARING DOMESTIC APPLIANCE AND DOMESTIC APPLIANCE FOR SAME

(75) Inventors: Gundula Czyzewski, Berlin (DE); Martina Wöbkemeier, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 489 days.

(21) Appl. No.: 10/758,872

(22) Filed: Jan. 16, 2004

(65) Prior Publication Data

US 2004/0182116 A1 Sep. 23, 2004

Related U.S. Application Data

(63) Continuation of application No. PCT/EP02/05414, filed on May 16, 2002.

(30) Foreign Application Priority Data

Jul. 19, 2001 (DE) ..... 101 35 191

(51) Int. Cl.
*D06F 33/02* (2006.01)

(52) U.S. Cl. ..... 8/158; 68/12.05; 68/12.19; 68/12.21

(58) Field of Classification Search ..... 68/12.02, 68/21.21, 12.19, 12.05; 8/159, 158
See application file for complete search history.

(56) References Cited

U.S. PATENT DOCUMENTS

| | | | | |
|---|---|---|---|---|
| 4,372,134 | A | 2/1983 | Matsuo | |
| 5,047,626 | A * | 9/1991 | Bobb et al. | 250/227.19 |
| 5,048,139 | A | 9/1991 | Matsumi et al. | |
| 5,083,447 | A | 1/1992 | Kiuchi et al. | |
| 5,373,714 | A | 12/1994 | Wada | |
| 5,438,507 | A | 8/1995 | Kim et al. | |
| 5,536,663 | A * | 7/1996 | Mueller-Kirschbaum et al. | 436/55 |
| 5,731,868 | A | 3/1998 | Okey et al. | |
| 5,800,628 | A | 9/1998 | Erickson et al. | |
| 6,924,499 | B2 * | 8/2005 | Poisel et al. | 250/574 |

FOREIGN PATENT DOCUMENTS

| | | | |
|---|---|---|---|
| DE | 29 49 254 | * | 6/1981 |
| DE | 36 26 351 | * | 2/1988 |
| DE | 197 40 266 | * | 3/1999 |
| JP | 1-209099 | * | 8/1989 |
| JP | 1-274797 | * | 11/1989 |
| JP | 2-215498 | * | 8/1990 |
| JP | 3-133490 | * | 6/1991 |

OTHER PUBLICATIONS

European Patent Office 0 966 914 Jun. 1999.*
European Patent Office 0 972 486 Jul. 1999.*

* cited by examiner

*Primary Examiner*—Frankie L. Stinson
(74) *Attorney, Agent, or Firm*—Russell W. Warnock; Craig J. Loest

(57) ABSTRACT

A sensor system for a water-bearing domestic appliance for monitoring the treatment fluid in the appliance. The sensor system measures the treatment fluid parameters in a program sequence that includes alternating idle and in motion operations of the appliance. The measured treatment fluid parameters can be compared to known proper operational treatment fluid parameters.

11 Claims, 2 Drawing Sheets

Figure 1:
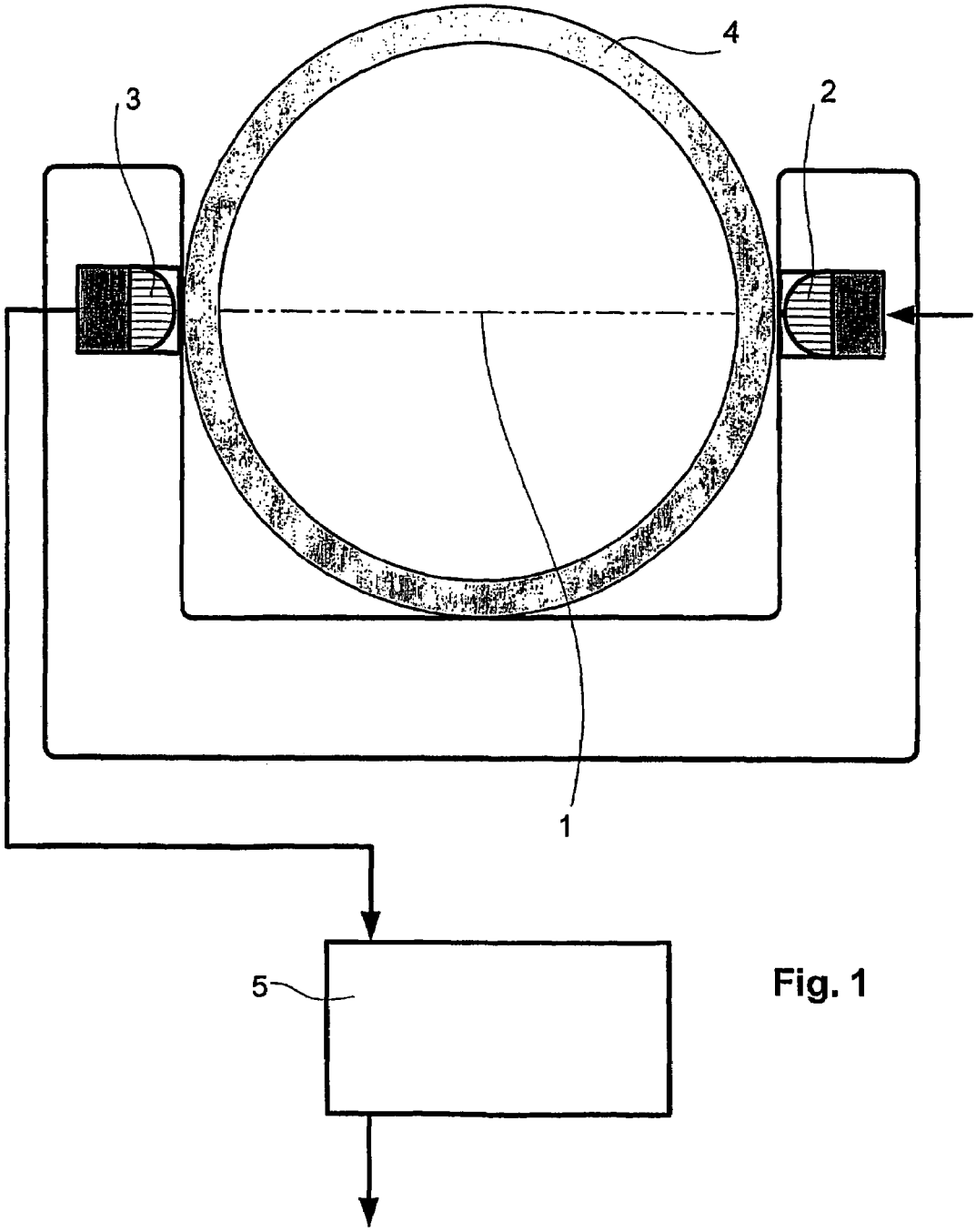

PROCESS FOR OPERATING A WATER-BEARING DOMESTIC APPLIANCE AND DOMESTIC APPLIANCE FOR SAME

This application is a continuation of PCT/EP02/05414 filed May 16, 2002.

The present invention relates to a process for operating a water-bearing domestic appliance with an optical sensor system for monitoring the treatment fluid, and a domestic appliance for carrying out the process.

Known sensor systems have at least one radiation source and one or more radiation receivers. Such sensors are used in multiple applications in particular in washing machines and dishwashing machines, whereby the physical effects of reflection, dispersion and/or refraction are utilised on optical limit surfaces.

Various known examples of application are detailed hereinbelow. In a comparison of the disclosed solutions there is a clear tendency to use sensors in various combinations.

DE 198 46 248 A1 discloses a washing machine with a turbidity sensor, i.e. with a sensor system for recognising the degree of contamination in the washing lye. Light source and receiver are arranged such that the penetrating light is measured. The turbidity of the medium is determined by the ratio of the values of the incoming and the outgoing light. The light can be monochromatic or have a broad spectrum. By using a mirror system light emitters and light receivers are freely arranged at considerable distances apart.

The turbidity sensor can also be used to recognise foam and thus contribute to the control of the rinse procedure. In spatial terms the turbidity sensor should be positioned in a region, where foam accumulates particularly well, such as in the discharge pipe.

DE 198 21 148 A1 describes the use of one or more rod-like sensor components. The recorded measured value is dependent on the different breaking index of the surrounding medium. The sensor component can now distinguish whether the surrounding medium is air, water or foam. The component can also be used to recognise level or detect the level in the lye tank. If the region under the floor-side heating unit in the lye tank is monitored, then the respective sensor component also acts as effective drying protection for the heating.

A combination solution is disclosed in DE 198 31 688 A1. With the sensor described here the continuous radiation and the radiation reflected on the contact surface of the sensor body to the surrounding medium can be detected. For this two radiation sources are operated in the time multiplex. The signals triggered by both radiation sources are recorded chronologically successively by the radiation receiver and according to their assignation they are evaluated for process control. The system allows the process to be optimised in terms of time, temperature, water and energy consumption.

DE 43 42 272 A1 presents a process, in which by means of evaluating the reflection behaviour on the surface of the washing lye several parameters such as level, turbidity of the lye and foam can be determined. In the process one or more optical radiation bundles are directed at the fictive surface of the lye at various angles of incidence and the reflections are measured by means of several photodiodes positioned on a receiver shield. Depending on which of these photodiodes is illuminated and at what intensity, an electronic evaluation circuit can detect the type and magnitude of the measured parameters.

Foam formation is recognised by diffuse distribution of the received light. The washing lye is turbid whenever the received signal is weakened evenly. The light cone striking different photodiodes of the receiver shield detects the level in the lye tank.

Optical sensor systems are interference-prone. Faults in determining the washing lye turbidity can occur through calcification of the optical measured section. Since the measured section dries out after each work process, the working beam in the optical measured section can already be so strongly damped in clear water that the signal evaluation circuit fixes supposed lye turbidity. DE 197 21976 A1 opposes this by suggesting measuring the damping of the measured section during each work cycle without turbid lye. This measured value is then compared to a threshold value. A control signal is emitted for the discharge control whenever the measured value reaches or almost reaches the threshold value.

The optical sender (e.g. LED) and optical receiver (e.g. photo transistor or photo resistor) working as turbidity sensor are strongly dependent on temperature. Without corresponding temperature compensation any fluctuations in temperature would be interpreted as fluctuations in the turbidity value and would also lead to false evaluation results. Accordingly temperature compensation of the turbidity sensor in all appliances is necessary, in which the cleaning fluid is heated up. In DE 195 21 326 A1 a process is put forward to compensate the temperature-dependent parameters individually and to dynamically adapt the detected compensation factor.

In addition, according to a process put forward in DE 197 55 360 A1 the sensor is used for measuring the degree of contamination for temperature measuring. The optical sensor is preferably located in the vicinity of the lye, so that there is the best possible thermal coupling between the sensor and the lye. A defined current is fed to the input of the sensor and the temperature-dependent threshold voltage on the output of the sensor is callipered. The temperature-dependent output signal is evaluated and used to control a heating element. This means that the usual temperature sensor in the water cycle can be dispensed with.

In order to recognise excessive colouring of the washing lye, caused by so-called bleeding, DE 199 08 803 A1 proposes an arrangement, in which three light-emitting diodes are used, which radiate light into the washing lye using three different narrow-band wavelength regions, typical for recognising colours. There the irradiated light reaches the photodiode either as direct or as light radiation scattered laterally on the colour particles, or as light radiation back-scattered on the colour particles. The direct, the laterally scattered and the back-scattered quantity of light can be determined for each light-emitting diode at the same time by means of three photodiodes disposed at approximately right angles to one another. In the case of three light-emitting diodes, which emit monochromatic light at varying wavelengths and chronologically offset, different dyes dissolved in the washing lye can be determined. When a threshold value is exceeded an alert signal is sent, and a rinse cycle with clear water is initiated.

The object of the invention is to expand on the options of process monitoring in domestic water-bearing appliances, in particular in washing machines or dishwashing machines, using known optical sensor systems.

This task is solved by the characteristics of the invention specified in claim 1. Advantageous embodiments of the invention are contained in the sub-claims.

Accordingly, in the invention the parameter values of the treatment fluid measured by the sensor system are monitored for abnormal deviations. In addition, the chronological sequence of successively measured parameter values can be recorded and compared to a sequence typical of proper operation. Further, two measured values can be recorded and a differential value can be developed therefrom, whereby the first measured value is detected when the system is idle, for example when a washing drum is idle, and the second value is detected when the system is in motion, thus when the washing drum is rotating. The measured value difference must reach a minimum value, for example. If the minimum value is exceeded then an alert signal is emitted. The level of the minimum value is dependent on the available sensor system and must be deposited with a corresponding value in the program memory.

In an advantageous embodiment of the invention, when the washing drum is both idle and operating, several measured values are recorded and in each case an average value is developed therefrom, which is then employed as a comparative value for the differential value. This measure makes the measuring method more secure; random errors, which might possibly falsify the measured value, can thus be excluded.

The inventive process can advantageously also be continued in such a way, where a tendential sequence of the measured values is detected from several measured values of the idle or motion phase, i.e. a drop or a rise in the level of the measuring signal over the observed period. This process is to be utilised advantageously in sensor systems used for foam recognition. Because foam formation lags at the beginning of the motion phase and the foam builds up relatively slowly when the washing drum is idle, certain inertia becomes attached to the inventive process, which cannot be adequately compensated by the abovedescribed average value. Detecting the change in the measured value creates remedial measures over time. Opposing tendencies in the idle phase compared to the operating phase point out that the mechanical drive system works free of interference.

By using known optical sensors the invention offers the advantage of creating a further control possibility for the proper work cycle of a water-bearing domestic appliance and thus increasing the operating safety of the appliance. The inventive process can be applied independently of the special structural design of the sensor system, independently of the physical basic principle and also independently of the concrete application. It should only be required that the values detected by the sensor when the work system is both idle and in motion display a sufficiently large difference. Sensor systems, such as explained hereinabove for example, can be used without employing additional component groups or components for the inventive process. The expense to be additionally invested is reduced to modifying the available operating programs, i.e. to the configuration of software.

Because the inventive process relates merely to the relative differences between the measured values when the work system is both idle and in motion, the absolute level of the individual measured values plays no part in the functional integrity of the process. This brings about the considerable advantage that the process works safely independently of the degree of pollution in the washing lye, its temperature, the washing agent concentration and the calcification of the measured section.

The invention will now be explained in greater detail hereinbelow in terms of a simple and known example. In the diagram, FIG. 1 shows a cross-section through a pipe section with an applied, known optical sensor system for a washing machine, and FIGS. 2 and 3 show various turbidity sequences in the optical measured section when the system is in motion and when it is not in motion.

A light-emitting diode 2 and a phototransistor 3 are arranged opposite on the external periphery of a pipe section 4 made of a transparent material. The pipe section 4 is a part of the discharge pipe connecting directly to the lye tank. Such an arrangement of light-emitting diode 2 and phototransistor 3 can preferably be located in the lower region of the lye tank of the washing machine. The light signal output by the light-emitting diode 2 and passing through the washing lye in the pipe section 4 is measured by the phototransistor 3. The measured value is conveyed to a microprocessor 5. The size of the measured value detected by the phototransistor 3 is dependent on the damping of the emitted light signal, caused by the turbidity of the washing lye or by foam build-up in the region of the measured section 1. Depending on program segment and size of the detected measured values signals for ongoing control of the washing machine are generated by the microprocessor 5.

Figure 2:
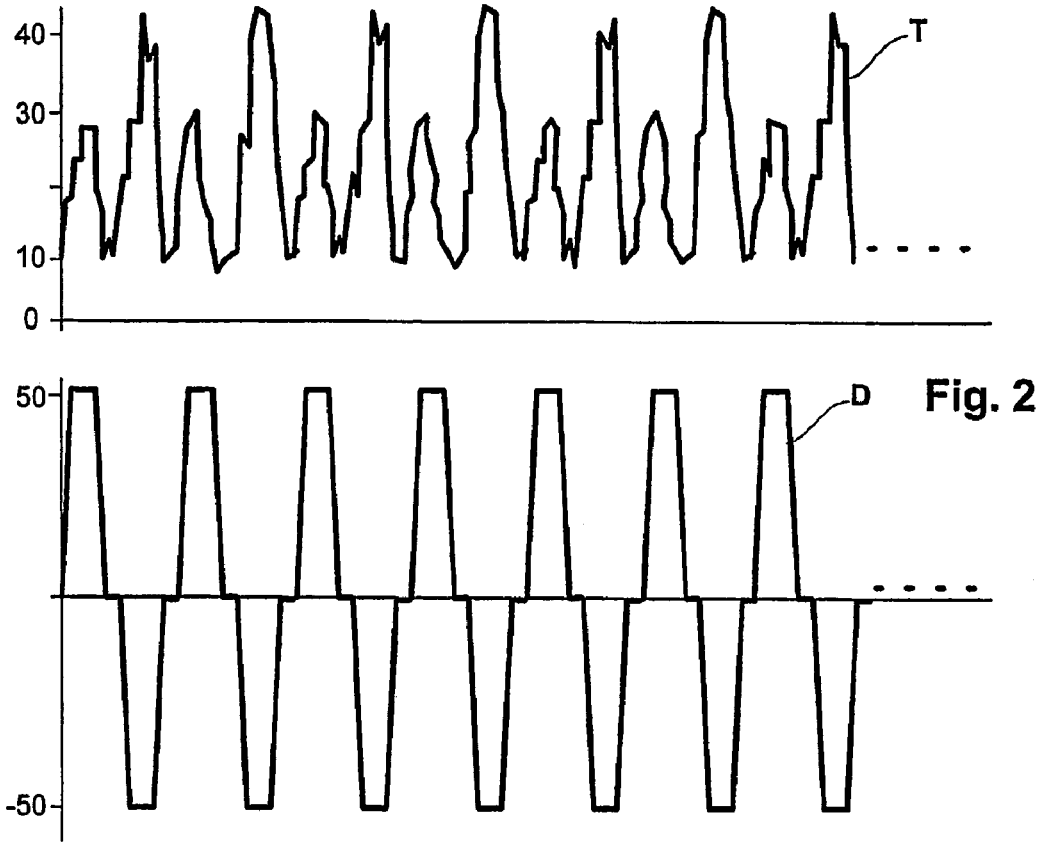
Figure 3:
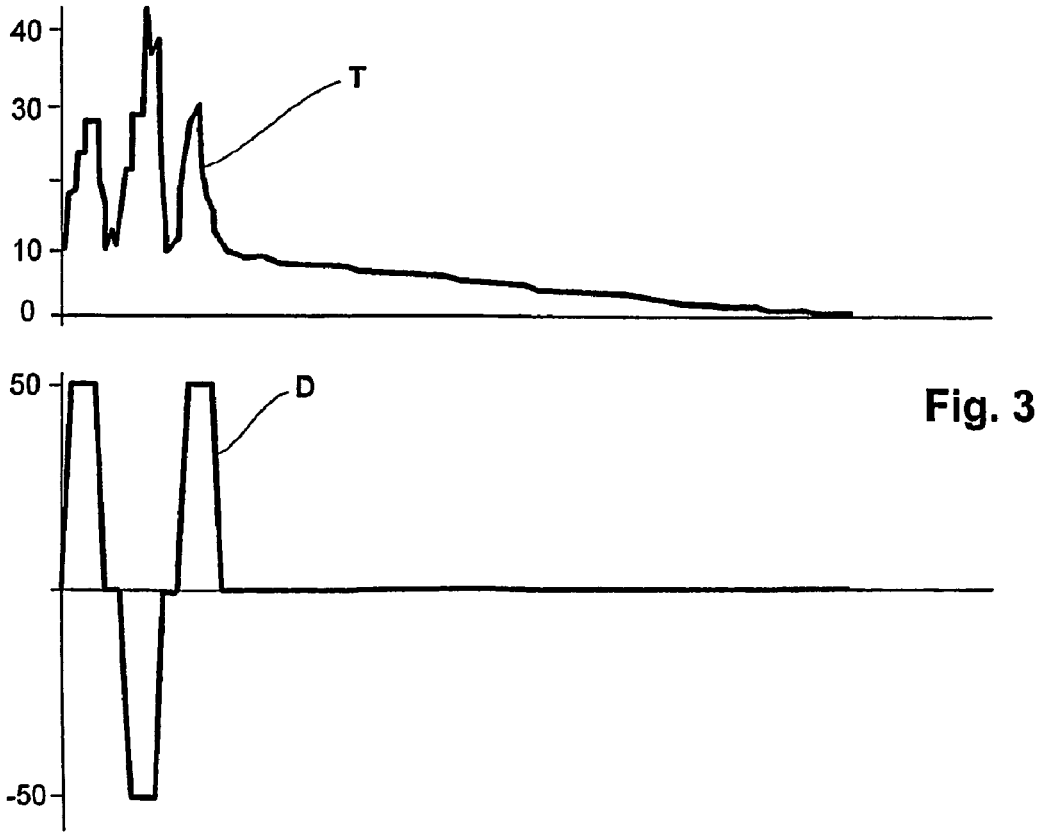

With reference to the diagrams in FIGS. 2 and 3 it is evident how a first measured value 30 or 40, the motion measured value, recorded in motion (namely when the washing drum is in motion), can be compared through the inventive process to a second measured value 10, the idle measured value, recorded when the washing drum is idle. At the same time the motion measured values 30 and 40, which come about through the corresponding speed values 50 and −50, are differentiated in the speed diagram D in the turbidity diagram T, depending on the direction of rotation of the washing drum, observed in each case in FIG. 2. The idle measured values 10 are still above a base line of 0.

If the detected measured value difference is below a predetermined set value, and if the idle value and that value, which would have to be measured in motion, are only approximately the same, this circumstance can indicate a malfunction in the drive system. The malfunction can affect the drive motor or the motion transfer system, caused by a V-belt splitting. To be able to still differentiate both these possible malfunctions, another sensor would have to be installed, which can monitor the rotation of the drive motor directly, for example a tachogenerator connected directly to the drive motor for speed regulation.

This situation is shown in FIG. 3, in which the drum drive breaks down after motion×3 (2×50 and 1×50). Accordingly the measured motion values drop below 10 and can no longer be distinguished from the measured idle values.

To exclude randomly occurring fluctuations in measured value resulting in misinterpretation and as a result indicating a phantom malfunction, several measured values, from which the idle or motion value is developed as average value, are recorded while the drum is idle and in motion. Recording the measured value according to the inventive process is repeated several times during the washing program. The idle value is newly determined for example each time the rotation motion is switched over during the short idle phase and compared to the motion value measured immediately afterwards. The time intervals between recording the measured value are very short. Falsification of the measured signal, caused by fluctuations in temperature in the heating phase or by a sharp increase in the contamination in the washing lye, can be excluded in this way. Corrections in the measuring system, as described in the examples of the prior art, are not required for functioning of the inventive process. Similarly, the ageing of the sensors used or calcification of the measured section does not have an interfering effect. In the spin cycle the chronological sequence of the measured values is detected by the sensor system over a time interval determined by the program, i.e. the rise or fall in the measured values is detected over time. Consideration is given to the fact that foam can accumulate during spinning in the lower region of the lye tank, and this can slowly disintegrate again when the drum is idle. The mechanical drive system works fault-free, when the measured value increases in the idle phase and falls during spinning.

The set value stored in program memory, which serves as comparative value for the measured values of the sensor, is to be easily detected from trials. Different set values can be stored for various program segments.

The invention claimed is:

1. A process for operating a water-bearing appliance with an optical sensor system for monitoring the treatment fluid in the appliance, with treatment fluid parameter values having known proper operation parameter values, comprising:

operating the water-bearing appliance in a program sequence with the water-bearing appliance alternately idle and in motion during said program sequence;

measuring the parameter values of said treatment fluid in said appliance during said program sequence;

comparing said measured program sequence treatment fluid parameter values with the known proper operation treatment fluid parameter values to monitor said treatment fluid for abnormal deviations from said known proper operation treatment fluid parameter values; and measuring and recording the chronological sequence of successively measured parameter values of said treatment fluid and comparing said measured sequence of parameter values to a chronological sequence of parameter values typical of a proper operation.

2. The process according to claim 1, including at least one of generating a warning signal or discontinuing said program sequence when said chronological sequence of measured parameter values of said treatment fluid deviates from said chronological sequence of parameter values typical of a proper operation.

3. The process according to claim 1, including measuring said treatment fluid to obtain several values in each of said program idle and in motion phases and forming said chronological sequence of parameter values typical of a proper operation for both phases therefrom.

4. The process according to claim 1, including said domestic appliance is a washing machine.

5. The process according to claim 1, including said domestic appliance is a dishwashing machine.

6. A process for operating a water-bearing appliance with an optical sensor system for monitoring the treatment fluid in the appliance, with treatment fluid parameter values having known proper operation parameter values, comprising:

operating the water-bearing appliance in a program sequence with the water-bearing appliance alternately idle and in motion during said program sequence;

measuring the parameter values of said treatment fluid in said appliance during said program sequence;

comparing said measured program sequence treatment fluid parameter values with the known proper operation treatment fluid parameter values to monitor said treatment fluid for abnormal deviations from said known proper operation treatment fluid parameter values; and calculating a differential value from at least a first measured parameter value during an idle phase with at least a second measured parameter value during a motion phase of said program sequence and comparing said differential value of said parameter values to a differential value of parameter values typical of a proper operation to monitor deviations from said differential value of parameter values typical of a proper operation.

7. The process according to claim 6, including said differential value of parameter values typical of a proper operation is a predetermined reference value.

8. The process according to claim 6, including at least one of generating a warning signal or discontinuing said program sequence when said differential value of measured parameter values of said treatment fluid deviates from said differential value of parameter values typical of a proper operation.

9. The process according to claim 6, including measuring said treatment fluid to obtain several values and calculating an average value from said several measured values in each of said program idle and in motion phases and forming said differential value of parameter values typical of a proper operation from said average values.

10. The process according to claim 6, including said domestic appliance is a washing machine.

11. The process according to claim 6, including said domestic appliance is a dishwashing machine.

* * * * *